US011041642B2

(12) United States Patent
Satou

(10) Patent No.: US 11,041,642 B2
(45) Date of Patent: Jun. 22, 2021

(54) INDOOR UNIT OF AIR CONDITIONER

(71) Applicant: DAIKIN INDUSTRIES, LTD., Osaka (JP)

(72) Inventor: Kouji Satou, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/765,409

(22) PCT Filed: Nov. 15, 2018

(86) PCT No.: PCT/JP2018/042297
§ 371 (c)(1),
(2) Date: May 19, 2020

(87) PCT Pub. No.: WO2019/098276
PCT Pub. Date: May 23, 2019

(65) Prior Publication Data

US 2020/0326078 A1 Oct. 15, 2020

(30) Foreign Application Priority Data

Nov. 20, 2017 (JP) ..... JP2017-222704

(51) Int. Cl.
*F24F 1/0011* (2019.01)
*F24F 1/0063* (2019.01)

(52) U.S. Cl.
CPC ..... *F24F 1/0011* (2013.01); *F24F 1/0063* (2019.02)

(58) Field of Classification Search
CPC ..... F24F 1/0007; F24F 1/0011; F24F 1/0063; F24F 1/0068; F24F 13/10; F24F 13/14;
(Continued)

(56) References Cited

U.S. PATENT DOCUMENTS 5,958,114 A 9/1999 Sunahara et al.
2016/0348934 A1* 12/2016 Bailey
(Continued)

FOREIGN PATENT DOCUMENTS

CN 107166520 A 9/2017
EP 2 208 943 A1 7/2010
(Continued)

OTHER PUBLICATIONS

International Search Report for PCT/JP2018/042297 (PCT/JP/210) dated Jan. 29, 2019.
(Continued)

*Primary Examiner* — Vivek K Shirsat
*Assistant Examiner* — Ko-Wei Lin
(74) *Attorney, Agent, or Firm* — Birch, Stewart, Kolasch & Birch, LLP

(57) ABSTRACT

In an indoor unit of an air conditioner that moves a front panel, a coupling member suppresses a reduction of heat exchange performance of the indoor unit. A heat exchanger has a U-shaped pipe that returns refrigerant flowing in a longitudinal direction. A panel drive unit generates a driving force that moves the front panel by a movement of the panel drive unit itself. The coupling member is disposed behind the front panel, couples the front panel and the panel drive unit, and transmits the driving force from the panel drive unit to the front panel. At least a part of the coupling member is disposed in front of the U-shaped pipe so as to overlap the U-shaped pipe as viewed from the front.

19 Claims, 13 Drawing Sheets

(58) Field of Classification Search
CPC ..... F24F 13/1426; F24F 2013/1433; F24F 2013/1446
USPC ..... 454/333, 338
See application file for complete search history.

(56) References Cited

U.S. PATENT DOCUMENTS

| | | | |
|---|---|---|---|
| 2017/0176044 | A1* | 6/2017 | Kezar |
| 2017/0198936 | A1* | 7/2017 | Yamaguchi |
| 2018/0023821 | A1* | 1/2018 | Kim |
| 2018/0119983 | A1* | 5/2018 | Tezuka |
| 2018/0231266 | A1* | 8/2018 | Fradkin |

FOREIGN PATENT DOCUMENTS

| | | | |
|---|---|---|---|
| JP | 3-191229 | A | 8/1991 |
| JP | 7-133941 | A | 5/1995 |
| JP | 10-232049 | A | 9/1998 |
| JP | 11-101472 | A | 4/1999 |
| JP | 2000-234760 | A | 8/2000 |
| JP | 2005-147626 | A | 6/2005 |
| JP | 2005-147627 | A | 6/2005 |
| JP | 2005-188815 | A | 7/2005 |
| JP | 2016-161212 | A | 9/2016 |
| KR | 20-2009-0000950 | U | 2/2009 |
| KR | 10-2009-0041611 | A | 4/2009 |
| KR | 10-2016-0080314 | A | 7/2010 |
| WO | WO2018074718 | * | 8/2017 |

OTHER PUBLICATIONS

Extended European Search Report dated Dec. 11, 2020 in corresponding European Application No. 18877770.0.

* cited by examiner

INDOOR UNIT OF AIR CONDITIONER

TECHNICAL FIELD

An indoor unit of an air conditioner with a moving front panel.

BACKGROUND ART

Examples of a conventional indoor unit of an air conditioner include, as described in Patent Literature 1 (JP 2000-234760 A), an indoor unit in which a front panel of a casing moves in a vertical direction and includes a panel drive unit that drives the front panel.

SUMMARY OF THE INVENTION

Technical Problem

In the indoor unit disclosed in Patent Literature 1, when a coupling member that transmits a driving force of the panel drive unit is disposed at a position where the coupling member interferes with air flowing into a heat exchanger in the compact indoor unit, heat exchange performance is reduced.

In this way, in an indoor unit of an air conditioner that moves a front panel, there is a need to address a problem how to prevent a reduction of heat exchange performance of the indoor unit caused by a coupling member.

Solution to Problem

An indoor unit of an air conditioner according to a first aspect includes a casing that has a front panel at a front of the casing and a back surface on a rear of the casing, the back surface being fixed to a wall, a heat exchanger that is housed in the casing and has a U-shaped pipe that returns refrigerant flowing in a longitudinal direction, a panel drive unit that is housed in the casing and generates a driving force that moves the front panel by a movement of the panel drive unit itself, and a coupling member that is disposed behind the front panel, couples the front panel and the panel drive unit, and transmits the driving force from the panel drive unit to the front panel, in which the coupling member is disposed in front of the U-shaped pipe so as to at least partially overlap the U-shaped pipe as viewed from a front.

In the indoor unit of the air conditioner, at least a part of the coupling member is disposed so as to overlap the U-shaped pipe as viewed from the front, and a space in front of the U-shaped pipe that hardly contributes to heat exchange performance is effectively utilized. As a result, a reduction of the heat exchange performance of the indoor unit can be suppressed.

An indoor unit of an air conditioner according to a second aspect is the indoor unit according to the first aspect, in which the U-shaped pipe includes a first U-shaped pipe disposed at a first end in the longitudinal direction, and a second U-shaped pipe disposed at a second end in the longitudinal direction, and the coupling member includes a first coupling member disposed in front of the first U-shaped pipe so as to at least partially overlap the first U-shaped pipe as viewed from the front, and a second coupling member disposed in front of the second U-shaped pipe so as to at least partially overlap the second U-shaped pipe as viewed from the front. In such a configuration, two spaces in front of the first U-shaped pipe and the second U-shaped pipe are effectively utilized. This can enhance the effect of suppressing the reduction of the heat exchange performance of the indoor unit.

An indoor unit of an air conditioner according to a third aspect is the indoor unit of the first or second aspect, in which the panel drive unit includes at least one gear disposed in front of a refrigerant pipe extending from the heat exchanger, and the coupling member rotates in accordance with a movement of the gear. This configuration allows a space in front of the refrigerant pipe to be effectively utilized. The compactness of the indoor unit 1 can be achieved.

An indoor unit of an air conditioner according to a fourth aspect is the indoor unit according to the third aspect, in which the gear is disposed at a position where at least a part of the gear does not overlap the heat exchanger as viewed from a side. This configuration makes it easy to design an arrangement of the panel drive unit and the refrigerant pipe.

An indoor unit of an air conditioner according to a fifth aspect is the indoor unit according to the third or fourth aspect, in which the gear configures a planetary gear mechanism. With this configuration, when a driving force is generated by a motor, for example, a moving part is easily concentrated near an extension line of a shaft to achieve the compactness of the indoor unit easily.

An indoor unit of an air conditioner according to a sixth aspect is the indoor unit according to any one of the third to fifth aspects, further including an electric component box that is housed in the casing and electrically connected to the panel drive unit, in which the gear has a center of the longitudinal direction of the gear, the center being disposed between a center of the longitudinal direction of the heat exchanger and a center of the longitudinal direction of the electric component box. This configuration can make the indoor unit more compact in the longitudinal direction than a configuration in which the center of the gear is disposed on the opposite side of the heat exchanger with the electric component box interposed therebetween.

An indoor unit of an air conditioner of a seventh aspect is the indoor unit of any one of the first to sixth aspects, in which the coupling member is a component member of a crank mechanism that converts a rotational movement of the panel drive unit into a reciprocating movement of the front panel that reciprocates between an upper front position and a rear lower position. This configuration allows a use of a small actuator that rotates, such as a motor, for the panel drive unit. Therefore, the compactness can be achieved at a low cost.

DESCRIPTION OF EMBODIMENT (1) Overall Configuration

Figure 1:
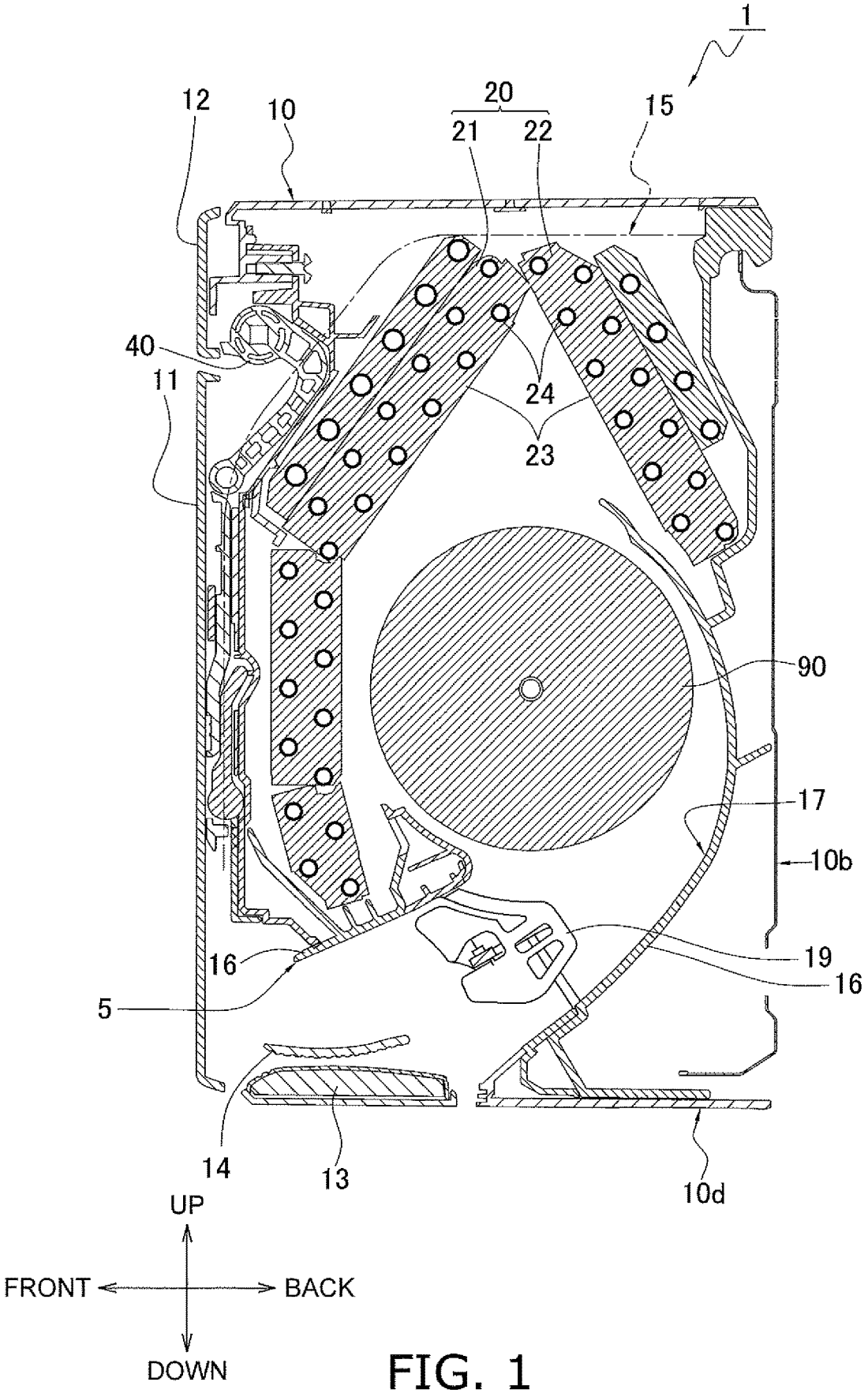
FIG. 1 is a cross-sectional view of an indoor unit that is stopped.

As shown in FIGS. 1 to 4, an indoor unit 1 of an air conditioner includes a casing 10, a heat exchanger 20, a coupling member 40, and a panel drive unit 50. The heat exchanger 20 and the panel drive unit 50 are housed in the casing 10. The indoor unit 1 is wall-mounted, and a back surface 10*b* on a rear of the indoor unit 1 is fixed to a wall.

Figure 2:
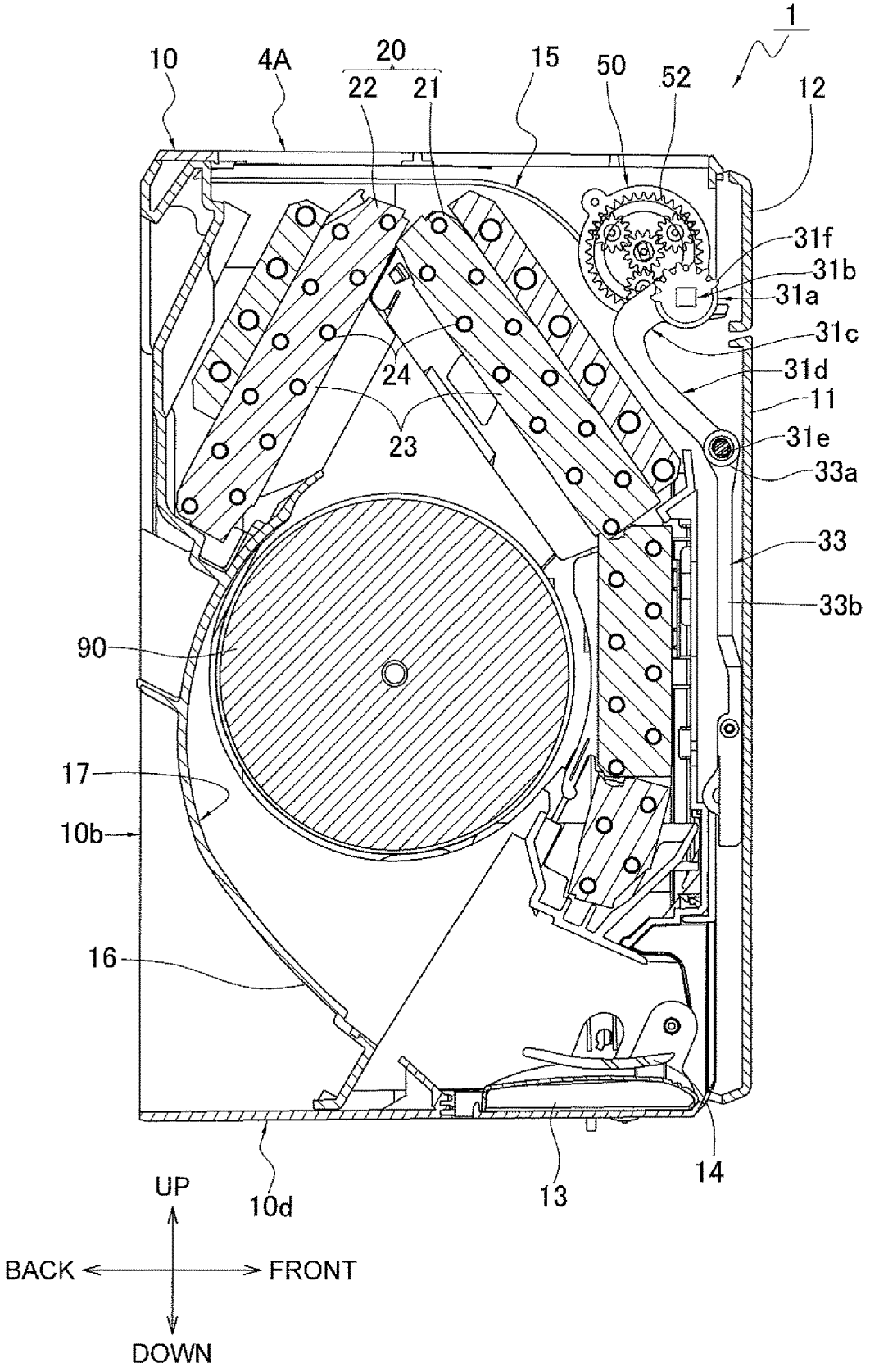
FIG. 2 is a cross-sectional view of the indoor unit that is stopped.
Figure 3:
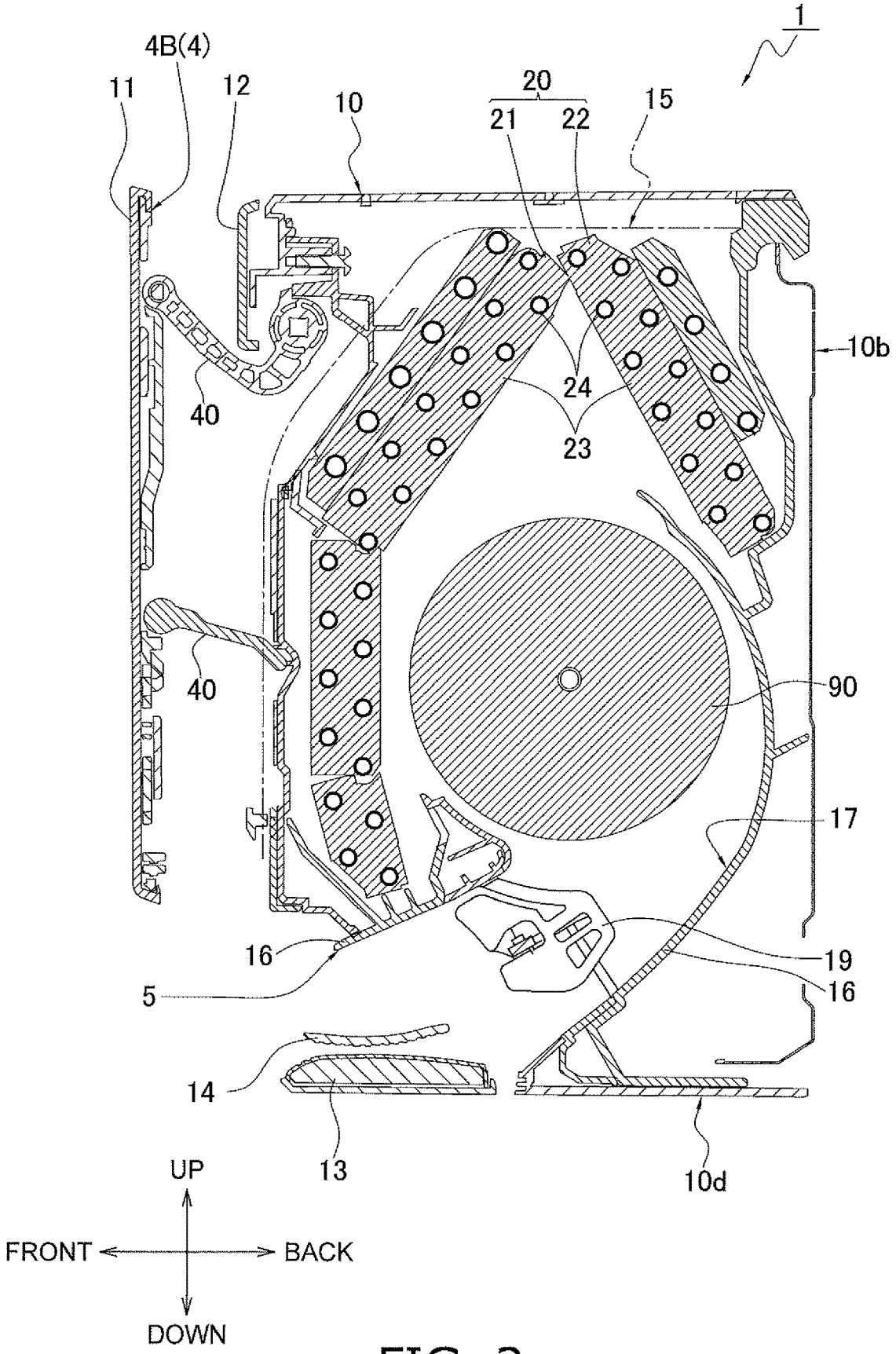
FIG. 3 is a cross-sectional view of the indoor unit in preparation for operation.
Figure 4:
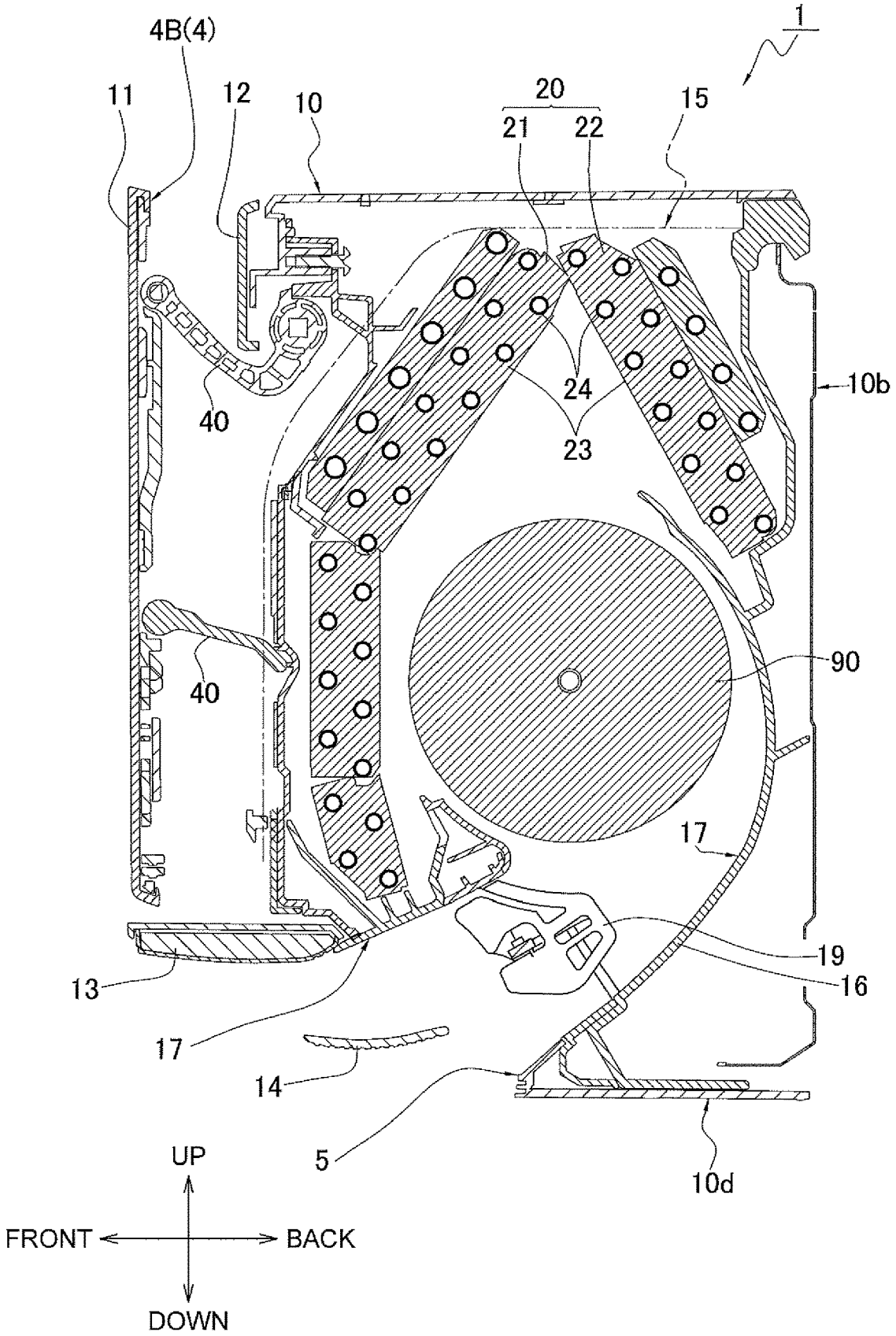
FIG. 4 is a cross-sectional view of the indoor unit in operation.

FIGS. 1 and 2 show the indoor unit 1 that is stopped. FIG. 3 shows the indoor unit 1 preparing for operation. FIG. 4 shows the indoor unit 1 in operation. FIGS. 1 and 2 are cross-sectional views of the indoor unit 1 cut at different positions along a plane extending in a front-and-rear direction and in an upper-and-lower direction.

Figure 5:
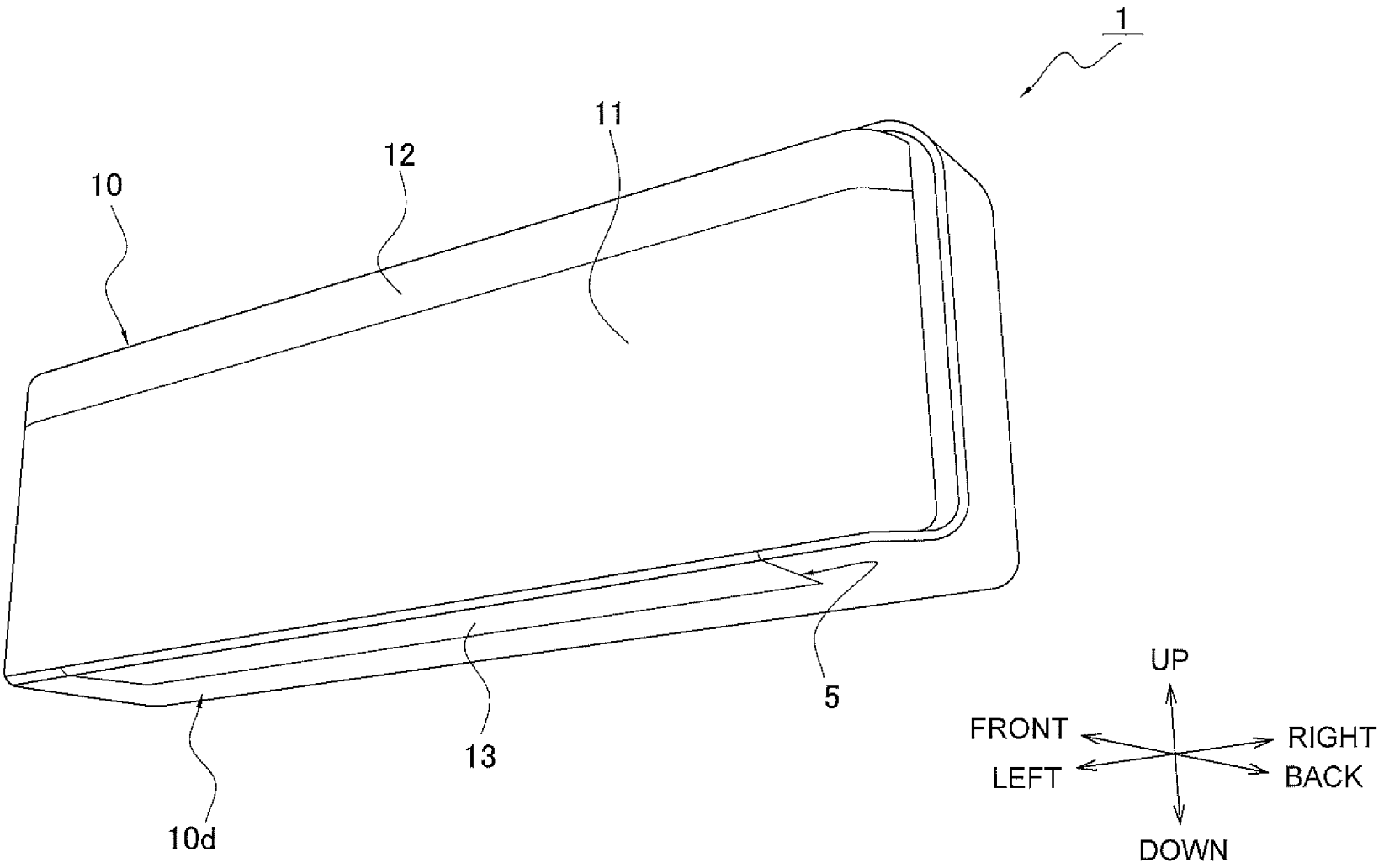
FIG. 5 is a perspective view of the indoor unit that is stopped.
Figure 6:
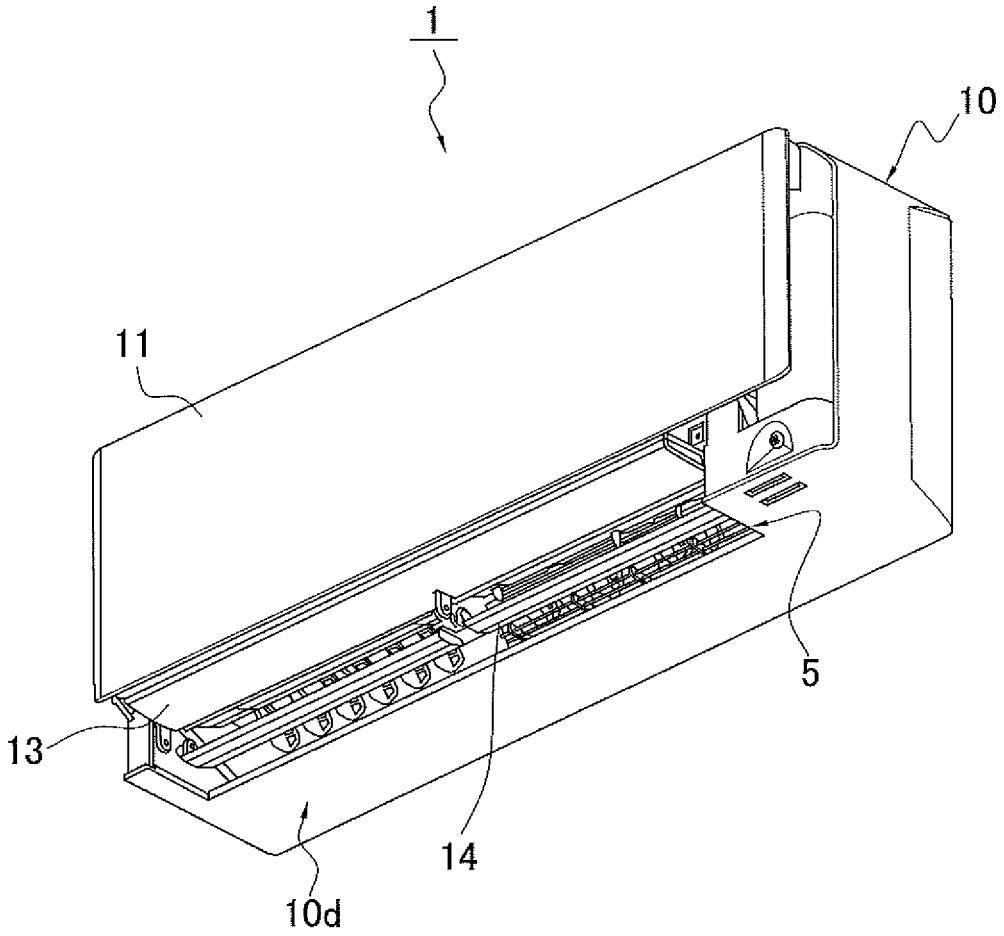
FIG. 6 is a perspective view of the indoor unit in operation.
Figure 6:
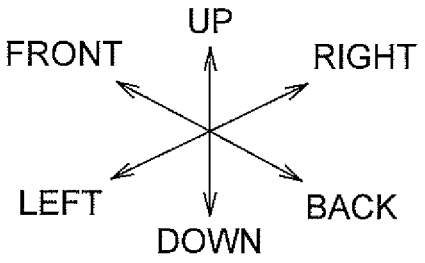
Figure 7:
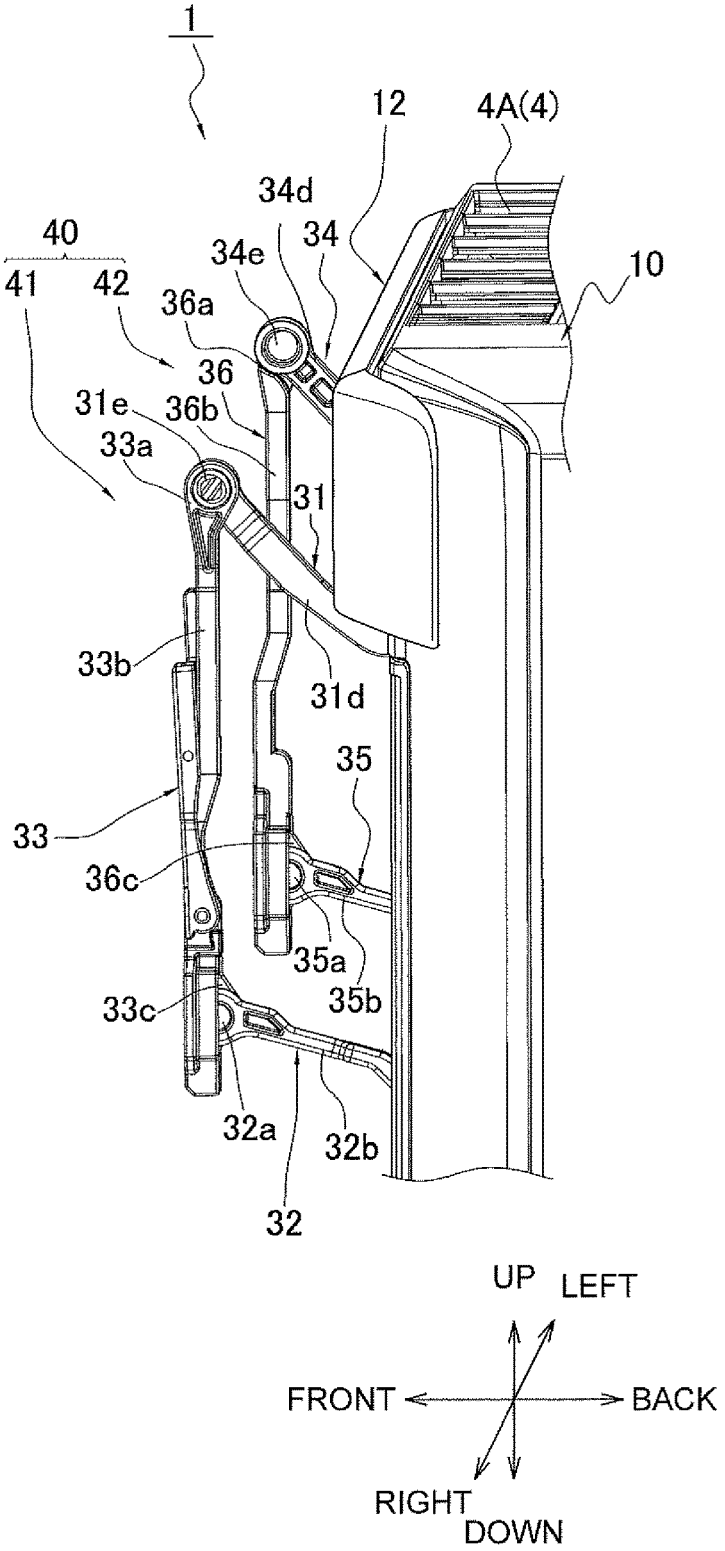
FIG. 7 is a partially enlarged perspective view showing a structure around a coupling member for driving a front panel.

The casing 10 has a movable front panel 11 and a fixed upper panel 12 at a front of the casing. FIGS. 5 and 6 respectively show an appearance of the indoor unit 1 that is stopped and an appearance of the indoor unit 1 in operation. As can be seen from FIGS. 1 to 6, when the indoor unit 1 is stopped, the front panel 11 is closed, or in other words, the front panel 11 is in a rear lower position. On the other hand, when the indoor unit 1 is preparing or operating, the front panel 11 is opened, or in other words, the front panel 11 is in an upper front position. FIG. 7 shows a configuration around the coupling member 40 with the front panel 11 removed from the indoor unit 1. The coupling member 40 is disposed behind the front panel 11.

Figure 8:
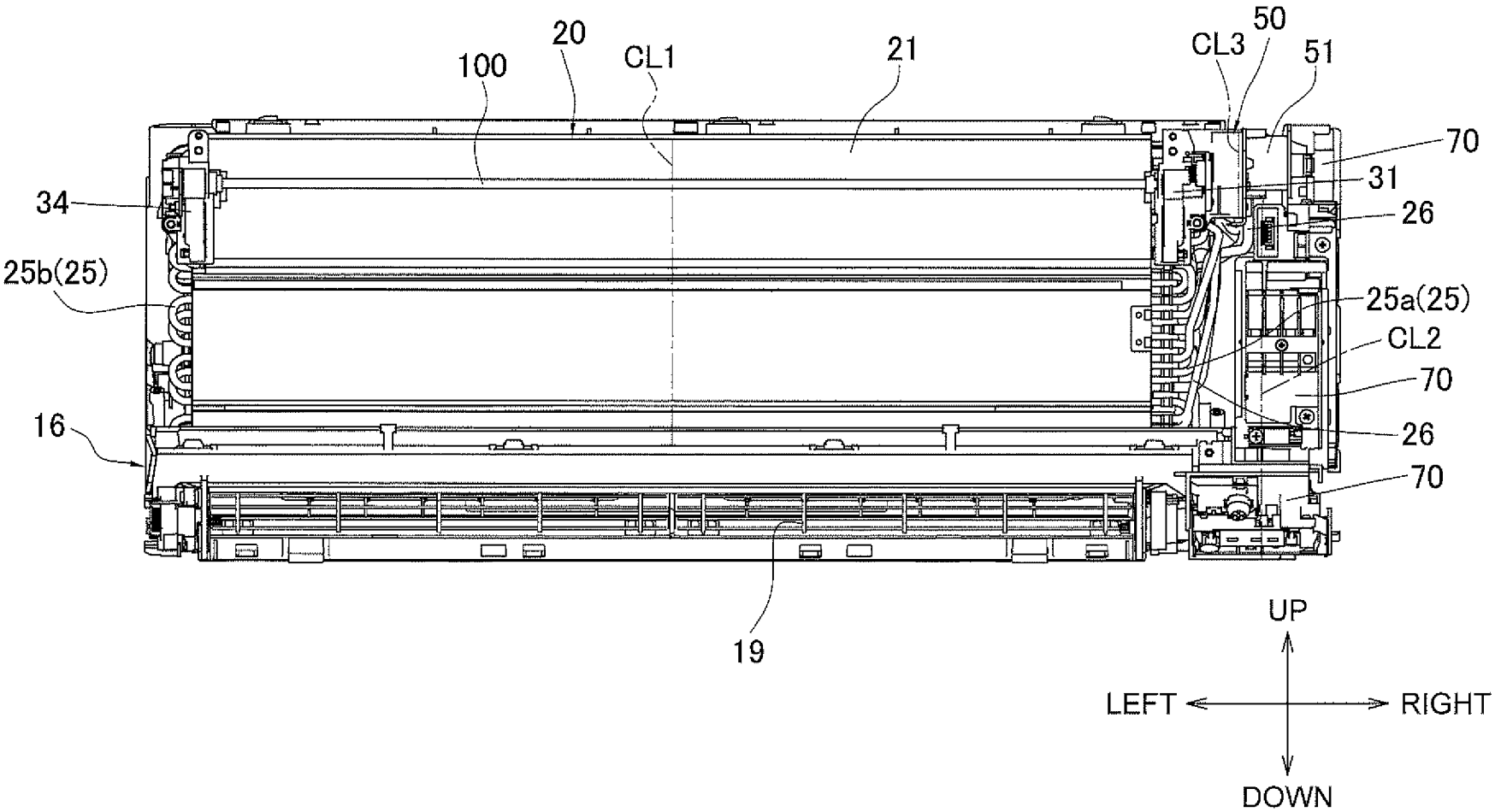
FIG. 8 is a front view showing a heat exchanger and a panel drive unit that are attached to a bottom frame.
Figure 9:
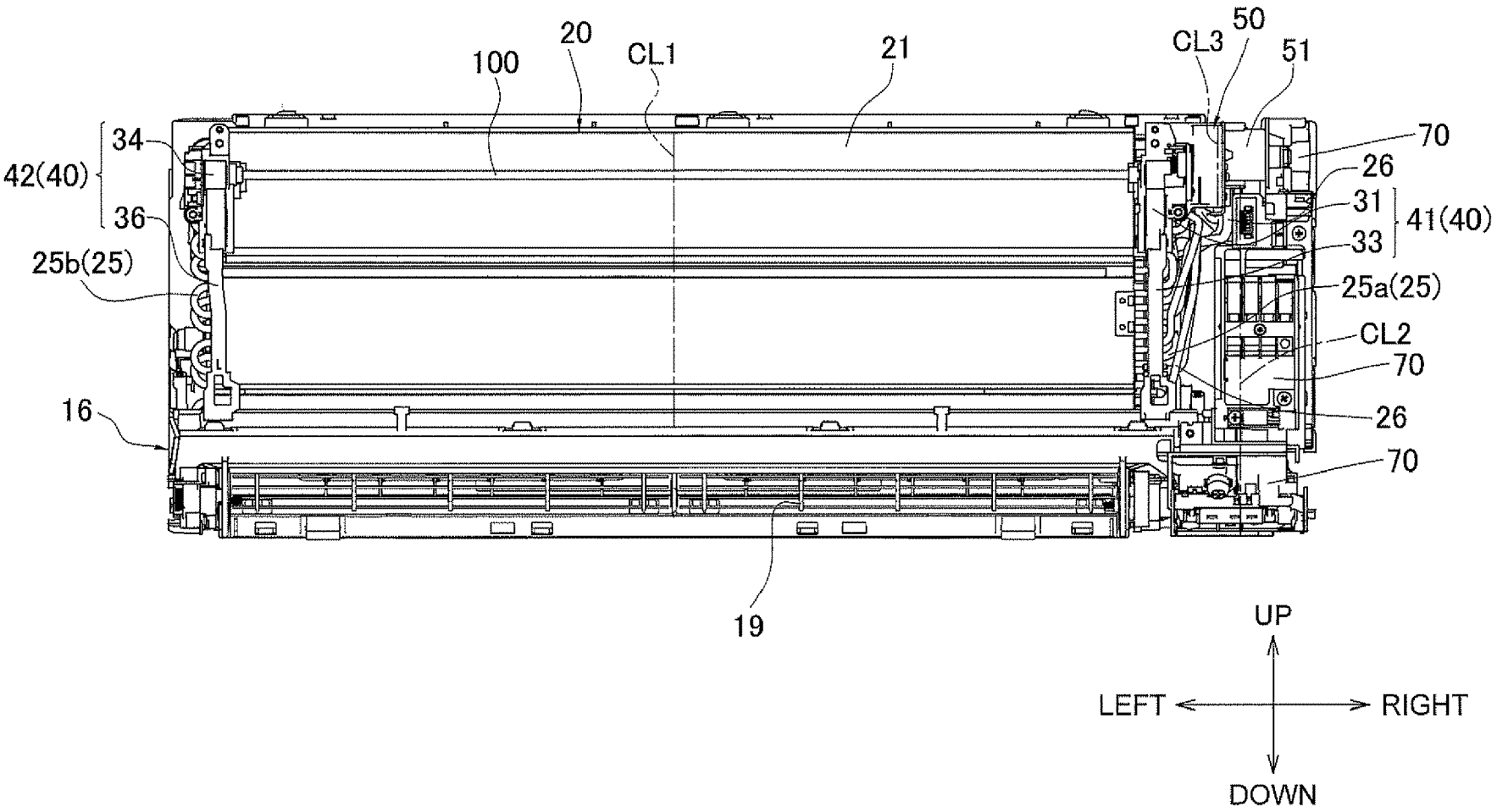
FIG. 9 is a front view showing the heat exchanger, the panel drive unit, and the coupling member that are attached to the bottom frame.

FIG. 8 shows the heat exchanger 20 and the panel drive unit 50 that are attached to a bottom frame 16. The heat exchanger 20 has a U-shaped pipe 25 that returns refrigerant flowing in a longitudinal direction (left and right direction) of the indoor unit 1 at both left and right ends of the heat exchanger 20. FIG. 9 shows the coupling member 40 in addition to the configuration shown in FIG. 8. As can be seen by comparing FIGS. 8 and 9, the coupling member 40 is disposed in front of the U-shaped pipe 25 so as to at least partially overlap the U-shaped pipe 25 as viewed from the front.

Figure 11:
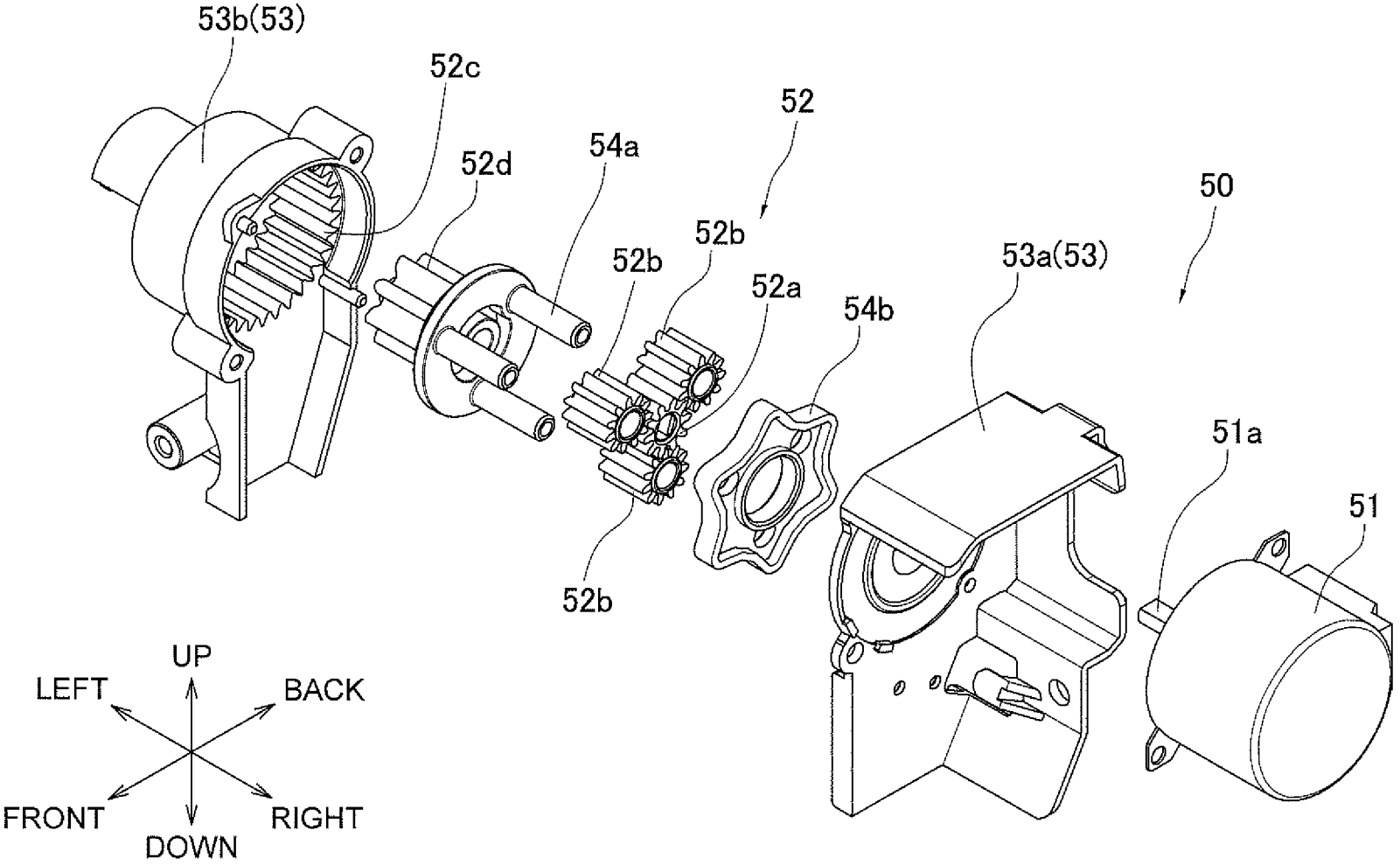
FIG. 11 is an exploded perspective view of the panel drive unit.

The panel drive unit 50 includes a motor 51 and a gear 52 (see FIG. 11). The motor 51 generates a driving force that moves the front panel 11 by a rotational movement of the motor itself. The rotational movement of the motor 51 is transmitted to the coupling member 40 through the gear 52 as the driving force for movement.

(2) Detailed Configuration (2-1) Casing 10

As shown in FIG. 1, when the indoor unit 1 is stopped, the front panel 11 is disposed on substantially the same plane as the upper panel 12. The front panel 11 that is in the rear lower position when the indoor unit 1 is stopped moves to the upper front position shown in FIG. 3 when the indoor unit 1 is in preparation for operation, whereby the upper panel 12 and the front panel 11 overlap each other as viewed from the front. After the front panel 11 moves to the upper front position, a first horizontal flap 13 that configures a bottom surface 10*d* of the casing 10 when the indoor unit 1 is stopped rotates and moves to an upper front position as shown in FIG. 4.

As can be seen from FIG. 5, the casing 10 has a rectangular parallelepiped shape that is longer in the left and right direction. In the indoor unit 1 shown in FIG. 5, the front panel 11 is closed, or in other words, the front panel 11 is in the rear lower position. On the other hand, in the indoor unit 1 shown in FIG. 6, the front panel 11 is opened, or in other words, the front panel 11 is in the upper front position. A suction port 4 includes not only an upper suction port 4A (see FIG. 7) formed on a top surface 10*c* of the casing 10, but also a front suction port 4B (see FIG. 3) that is opened by the movement of the front panel 11 to the upper front position when the indoor unit 1 is in operation.

The casing 10 houses a filter 15 disposed between the heat exchanger 20 and the suction port 4. Dust is removed, by the filter 15, from indoor air that enters the suction port 4 and passes through the filter 15. The indoor air that has passed through the filter 15 flows into the heat exchanger 20. The casing 10 houses a fan 90 on a downstream side of the heat exchanger 20. The fan 90 is, for example, a cross-flow fan that extends to left and right along the longitudinal direction of the heat exchanger 20. A blow-out passage 17 is formed on the downstream side of the fan 90. In FIG. 1 and other drawings, a plurality of blades disposed on a circumference of a partition plate is not shown because the cross-flow fan is cut at the partition plate of the cross-flow fan.

A plurality of vertical flaps 19 arranged in the longitudinal direction (left and right direction) is attached to the blow-out passage 17. The first horizontal flap 13 and a second horizontal flap 14 are attached downstream of the vertical flap 19. An outlet of the blow-out passage 17 is a blow-out port 5. The blow-out passage 17 and the bottom surface 10*d* of the casing 10 are configured by the bottom frame 16 made of resin.

FIG. 8 shows the heat exchanger 20 and the electric component box 70 that are disposed in the casing 10. The electric component box 70 is disposed on the right of the heat exchanger 20, or in other words, closer to the right in the casing 10. The electric component box 70 incorporates a control unit (not shown) that controls the motor 51, the fan 90, and the like.

(2-2) Heat Exchanger 20

As shown in FIG. 1, the heat exchanger 20 can be divided into a front heat exchange section 21 and a rear heat exchange section 22. An upper part of the front heat exchange section 21 and an upper part of the rear heat exchange section 22 are connected to each other. Due to such a structure of the heat exchanger 20, the heat exchanger 20 has a Λ shape as viewed from a side.

The heat exchanger 20 includes a plurality of metal heat transfer fins 23 disposed side by side in the longitudinal direction, a plurality of metal heat transfer tubes 24 that extends in the longitudinal direction through the plurality of heat transfer fins 23, the metal U-shaped pipe 25 that connects two of the heat transfer tubes in order to return and flow the refrigerant at an end of the heat exchanger 20. The U-shaped pipe 25 includes a first U-shaped pipe 25*a* disposed on the right as viewed from the front and a second U-shaped pipe 25*b* disposed on the left as viewed from the front. Further, a plurality of refrigerant pipes 26 is connected to the heat exchanger 20. The refrigerant flows into the heat exchanger 20 from the outside through the refrigerant pipes 26, and the refrigerant flows from the heat exchanger 20 to the outside through the refrigerant pipes 26.

(2-3) Coupling Member 40

As shown in FIG. 7, the coupling member 40 includes a first upper crank 31, a first lower crank 32, a first link 33, a second upper crank 34, a second lower crank 35, and a second link 36. The first upper crank 31, the first lower crank 32, and the first link 33 are a first coupling member 41, and configure a first parallel crank mechanism. The second upper crank 34, the second lower crank 35, and the second link 36 are a second coupling member 42 and configure a second parallel crank mechanism.

As shown in FIGS. 8 and 9, the first upper crank 31, the first lower crank 32, and the first link 33 that configure the first parallel crank mechanism of the coupling member 40 do not overlap the heat transfer fins 23 of the heat exchanger 20 at all as viewed from the front. The first upper crank 31, the first lower crank 32, and the first link 33 are in a range in which the first U-shaped pipe 25*a* is disposed, in the longitudinal direction as viewed from the front. The second upper crank 34, the second lower crank 35, and the second link 36 that configure the second parallel crank mechanism partially overlap the heat transfer fins 23 of the heat exchanger 20 as viewed from the front. The second upper crank 34, the second lower crank 35, and the second link 36 also partially overlap the second U-shaped pipe 25*b* as viewed from the front.

Therefore, the first upper crank 31, the first lower crank 32, and the first link 33 that configure the first coupling member 41 of the coupling member 40 do not disturb a flow of the indoor air flowing to the heat transfer fins 23 of the heat exchanger 20. Further, the second upper crank 34, the second lower crank 35 and the second link 36 that configure the second coupling member 42 partially overlap the heat transfer fins 23 but protrude toward the second U-shaped pipe 25*b* as viewed from the front. This suppresses disturbing the flow of the indoor air flowing to the heat transfer fins 23 at a left end of the heat exchanger 20. In particular, when the front panel 11 is opened, most of the second upper crank 34 and the second lower crank 35 are away from the heat transfer fins 23. Sufficient indoor air flows to the heat transfer fins 23 on the left end of the heat exchanger 20 similarly to the other parts.

Figure 10:
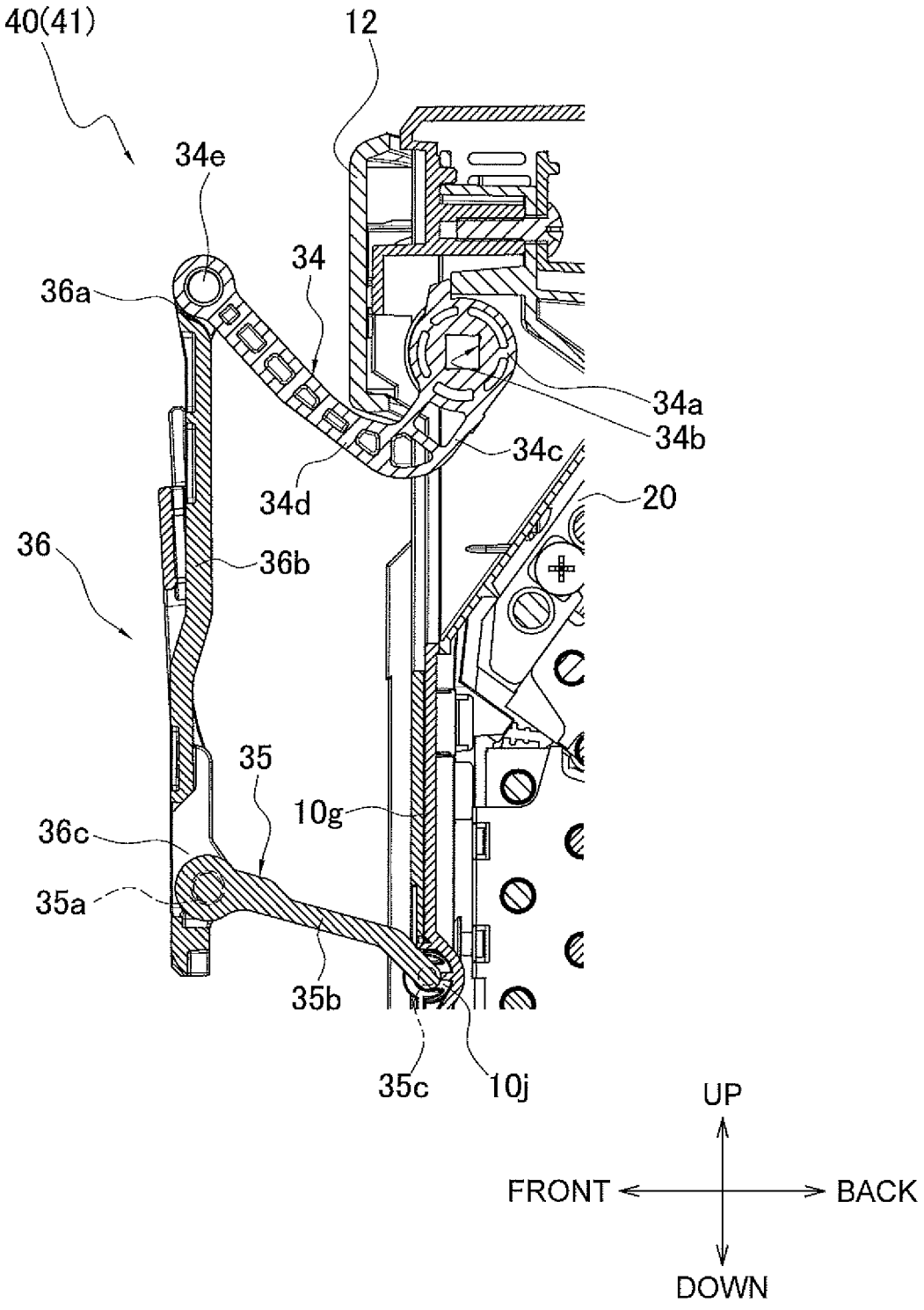
FIG. 10 is a partially enlarged cross-sectional view showing the structure around the coupling member for driving the front panel.

FIG. 10 mainly shows the second parallel crank mechanism. The second upper crank 34 of the second parallel crank mechanism is bent in an L shape as viewed from the side. A joint portion 34*a* is formed with a square coupling hole 34*b* into which a metal shaft 100 (see FIG. 8) having a square cross section is fitted. When the motor 51 rotates, the rotational movement of the motor 51 is transmitted to the metal shaft 100 via the gear 52. Further, the rotational movement of the metal shaft 100 is transmitted to the joint portion 34*a*. An inner arm 34*c* extends from the joint portion 34*a*. The inner arm 34*c* has a relatively short arm length so as not to collide with the upper panel 12 of the casing 10, the heat exchanger 20, and the like in a rotation range of the inner arm 34*c*. A direction in which a panel side arm 34*d* extends outward from the inner arm 34*c* is bent upward by about 90 degrees with respect to a direction in which the inner arm 34*c* extends as viewed from the side. The panel side arm 34*d* has an arm length longer than the arm length of the inner arm 34*c* in order to increase a moving distance of the front panel 11. A shaft 34*e* is provided at a panel side tip of the panel side arm 34*d*.

The shaft 34*e* of the second upper crank 34 is fitted into a bearing 36*a* provided at an upper end of the second link 36. The shaft 34*e* can rotate in the bearing 36*a*. A main portion 36*b* of the second link 36 extending downward from the bearing 36*a* also serves as an attachment plate to which the front panel 11 is attached. The front panel 11 is fixed to the main portion 36*b* with a pressure sensitive adhesive and/or an adhesive. A bearing 36*c* is provided at a lower end of the second link 36.

A shaft 35*a* of the second lower crank 35 is fitted into the bearing 36*c* of the second link 36. The shaft 35*a* can rotate in the bearing 36*c*. An arm 35*b* extends from the shaft 35*a* of the second lower crank 35 toward a casing body 10*g* in the back. The casing body 10*g* is a part of the casing 10 excluding the front panel 11. A shaft 35*c* is provided at the other end of the arm 35*b*. The shaft 35*c* of the second lower crank 35 is fitted into a bearing 10*j* of the casing body 10*g*. The shaft 35*c* of the second lower crank 35 can rotate in the bearing 10*j*. That is, the casing body 10*g* serves as a fixed link of the second parallel crank mechanism.

FIG. 2 mainly shows the first parallel crank mechanism. The first upper crank 31 of the first parallel crank mechanism is bent in an L shape as viewed from the side. A joint portion 31*a* is formed with a square coupling hole 31*b* into which the metal shaft 100 (see FIG. 8) having a square cross section is fitted. A plurality of teeth 31*f* meshed with the gear 52 is formed on an outer periphery of the joint portion 31*a*. When the motor 51 rotates, the rotational movement of the motor 51 is transmitted to the plurality of teeth 31*f* via the gear 52, and then the first upper crank 31 rotates. At this time, the rotational movement of the first upper crank 31 is transmitted to the metal shaft 100, and the rotational movement of the metal shaft 100 is transmitted to the joint portion 31*a*. An inner arm 31*c* extends from the joint portion 31*a*. The inner arm 31*c* has a relatively short arm length so as not to collide with the upper panel 12 of the casing 10, the heat exchanger 20, and the like in a rotation range of the inner arm 31*c*. A direction in which a panel side arm 31*d* extends outward from the inner arm 31*c* is bent upward by about 90 degrees with respect to a direction in which the inner arm 31*c* extends as viewed from the side. The panel side arm 31*d* has an arm length longer than the arm length of the inner arm 31*c* in order to increase a moving distance of the front panel 11. In this way, the first upper crank 31 has the inner arm 31*c* and the panel side arm 31*d* having substantially the same shapes as the shapes of the inner arm 34*c* and the panel side arm 34*d* of the second upper crank 34 described above. A shaft 31*e* is provided at a panel side tip of the panel side arm 31*d*.

The shaft 31*e* of the first upper crank 31 is fitted into a bearing 33*a* provided at an upper end of the first link 33. The shaft 31*e* can rotate in the bearing 33*a*. A main portion 33*b* of the first link 33 extending downward from the bearing 33*a* also serves as an attachment plate to which the front panel 11 is attached. The front panel 11 is fixed to the main portion 33*b* with a pressure sensitive adhesive and/or an adhesive. A bearing 33*c* is provided at a lower end of the first link 33.

A shaft 32*a* of the first lower crank 32 is fitted into the bearing 33*c* of the first link 33. The shaft 32*a* can rotate in the bearing 33*c*. An arm 32*b* extends from the shaft 32*a* of the first lower crank 32 toward the casing body 10*g* in the back. A shaft (not shown) is provided at the other end of the arm 32*b*. The shaft of the first lower crank 32 is fitted into a bearing (not shown) of the casing body 10*g*. The shaft of the first lower crank 32 can rotate in the bearing of the casing body 10*g*. That is, the casing body 10*g* also serves as a fixed link of the first parallel crank mechanism.

(2-4) Panel Drive Unit 50

Figure 12:
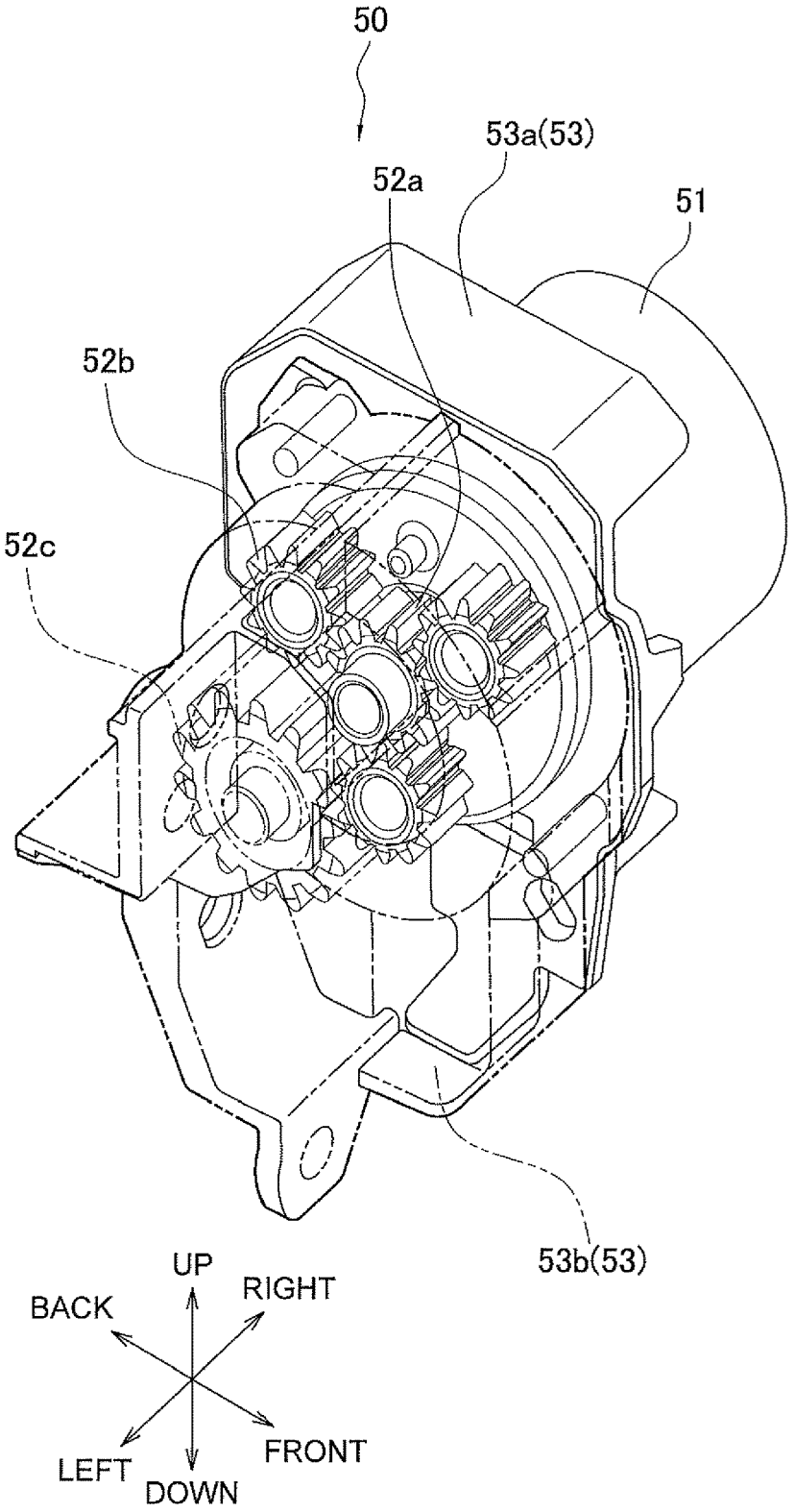
FIG. 12 is a perspective view of the panel drive unit.

FIG. 11 shows the panel drive unit 50 that has been disassembled. The panel drive unit 50 includes a motor 51, the gear 52, and a gear box 53. The gear shown in FIG. 11 configures a planetary gear mechanism. The planetary gear mechanism shown in FIG. 11 is a planetary type. The gear box 53 includes a motor support 53*a* and a gear support 53*b*. The motor 51 and the gear 52 are fixed to the casing 10 by the gear box 53. FIG. 12 shows the panel drive unit 50 that has been assembled.

Figure 13:
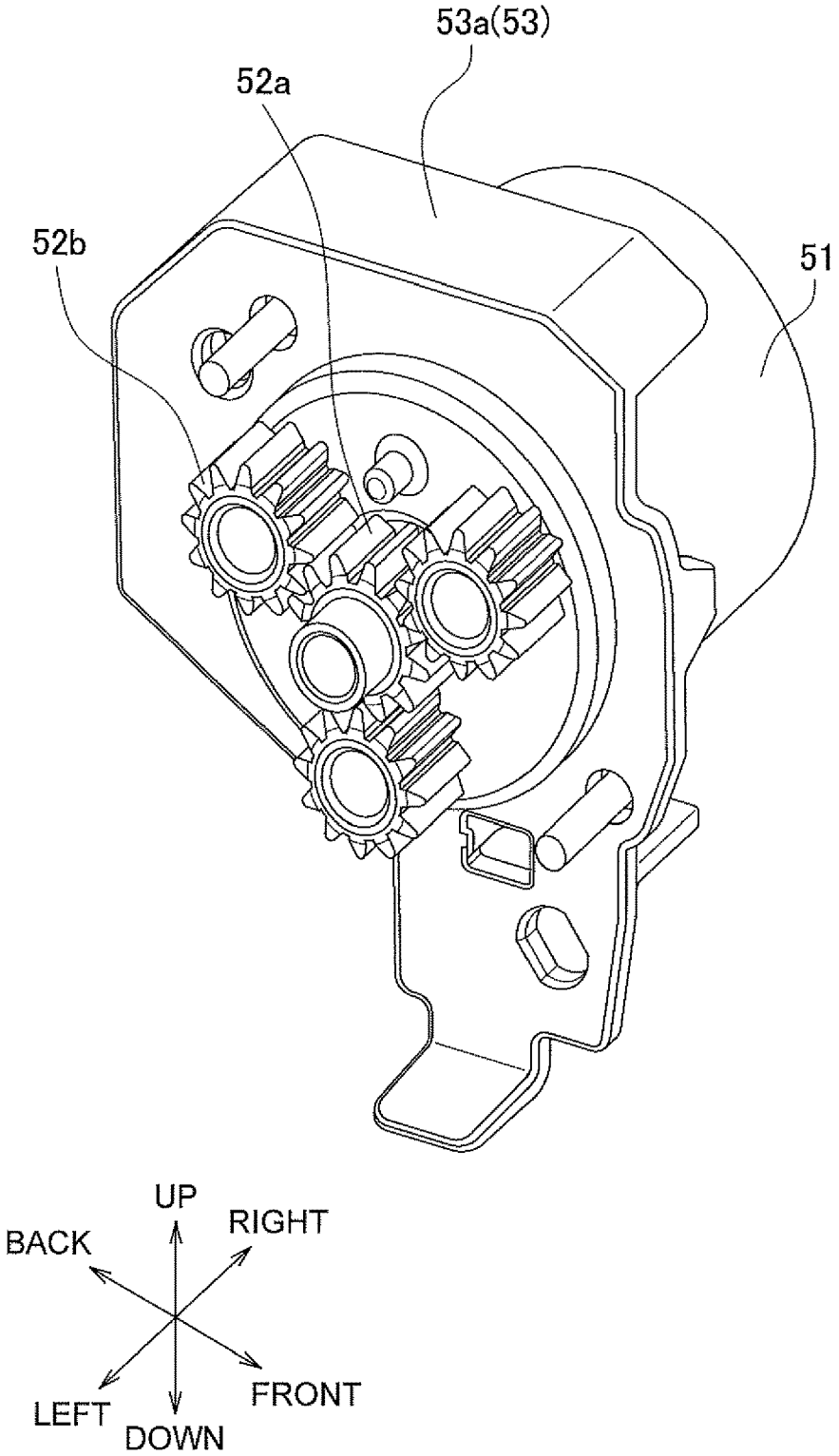
FIG. 13 is a perspective view showing a sun gear and a planetary gear of the panel drive unit.

The motor 51 is fixed to the motor support 53*a* of the gear box 53 by screws (not shown) or the like. A sun gear 52*a* is fixed to a shaft 51*a* of the motor 51. Three planetary gears 52*b* are disposed around the sun gear 52*a*, and all the three planetary gears 52*b* are meshed with the sun gear 52*a*. FIG. 13 shows the motor 51, the motor support 53*a*, the sun gear 52*a*, and the three planetary gears 52*b* being assembled.

The three planetary gears 52*b* are meshed with an internal gear 52*c* formed inside the gear support 53*b*. The internal gear 52*c* is fixed, and the three planetary gears 52*b* revolve around the sun gear 52*a* in accordance with a rotation of the sun gear 52*a*. Carriers 54*a* and 54*b* are attached to the three planetary gears 52*b*. The carriers 54*a* and 54*b* rotate in accordance with the revolution of the three planetary gears 52*b*. A gear 52*d* is fixed to the carrier 54*a*. Thus, the gear 52*d* rotates in accordance with the revolution of the three planetary gears 52*b*. A center axis of the gear 52*d* coincides with a center axis of the internal gear 52*c*, a center axis of the sun gear 52*a*, and the shaft 51*a* of the motor 51. Due to such a structure, the moving gear 52 can be concentrated near an extension line of the shaft 51*a* that generates the driving force by the motor 51. Therefore, the gear 52 can be disposed in a narrow space in front of the refrigerant pipes 26 of the compact indoor unit 1. The gear 52*d* is meshed with the teeth 31*f* disposed on the outer periphery of the joint portion 31*a* of the first upper crank 31.

As shown in FIG. 8, the gear box 53 is disposed in front of the refrigerant pipes 26 extending from the heat exchanger 20. That is, the refrigerant pipes 26 and the gear box 53 overlap each other as viewed from the front. In this embodiment, the gear box 53 is disposed in front of the refrigerant pipes 26, and all the plurality of gears 52 is disposed in front of the refrigerant pipes 26. Further, the two-dot chain lines indicated by reference signs CL1, CL2, and CL3 in FIG. 8 represent a center of the longitudinal direction of the heat exchanger 20, a center of the longitudinal direction of the electric component box 70, and a center of the longitudinal direction of the plurality of gears 52, respectively. As can be seen from FIG. 8, the center CL3 of the longitudinal direction of the gears 52 is disposed between the center CL1 of the longitudinal direction of the heat exchanger 20 and the center CL2 of the longitudinal direction of the electric component box 70. Further, as shown in FIG. 2, all the gears 52 are disposed at positions where the gears 52 do not overlap the heat exchanger 20 as viewed from the side.

In this way, the gears 52 are disposed in front of the refrigerant pipes 26, and the space in front of the refrigerant pipes 26 is effectively utilized by the gears 52. As a result, the compactness of the indoor unit 1 can be achieved. The space that is in front of the refrigerant pipes 26 and does not overlap the heat exchanger 20 as viewed from the side is a triangular prism-shaped space at an upper front corner of the casing 10. In this embodiment, all the gears 52 are disposed at the positions where the gears 52 do not overlap the heat exchanger 20 as viewed from the side. However, when at least a part of the gears 52 is disposed at a position where the part of the gears 52 does not overlap the heat exchanger 20 as viewed from the side, there is an effect of the easy designing although the degree of the effect is varied. When the gears 52 partially overlap the heat exchanger 20 as viewed from the side, it is easy to make the indoor unit 1 compact.

(3) Characteristics (3-1)

For example, as described with reference to FIGS. 8 and 9, in the indoor unit 1 described above, at least a part of the coupling member 40 is disposed so as to overlap the U-shaped pipe 25 as viewed from the front. In this way, the space in front of the U-shaped pipe 25 is effectively utilized for the arrangement of the coupling member 40. The space in front of the U-shaped pipe 25 that hardly contributes to heat exchange performance is effectively utilized by the coupling member 40. The flow of the indoor air sucked into the heat exchanger 20 from the front suction port 4B is suppressed from being blocked by the coupling member 40. As a result, a reduction of the heat exchange performance of the indoor unit 1 can be suppressed.

(3-2)

The coupling member 40 disposed so as to at least partially overlap the U-shaped pipe 25 as viewed from the front includes the first upper crank 31, the first lower crank 32, the first link 33 as the first coupling member 41, and the second upper crank 34, the second lower crank 35, and the second link 36 as the second coupling member 42. At least a part of the first coupling member 41 is disposed in front of the first U-shaped pipe 25*a* so as to overlap the first U-shaped pipe 25*a* as viewed from the front. Further, at least a part of the second coupling member 42 is disposed in front of the second U-shaped pipe 25*b* so as to overlap the second U-shaped pipe 25*b* as viewed from the front. The two spaces in front of the first U-shaped pipe 25*a* and the second U-shaped pipe 25*b* are effectively utilized on both sides of the heat exchanger 20. This can enhance the effect of suppressing the reduction of the heat exchange performance of the indoor unit 1.

(3-3)

In the panel drive unit 50 of the above embodiment, the space in front of the refrigerant pipes 26 is effectively utilized by all the gears 52 disposed in front of the refrigerant pipes 26 extending from the heat exchanger 20. The compactness of the indoor unit 1 can be achieved. In this embodiment, all the gears 52 are disposed in front of the refrigerant pipes 26. However, when a part of the gear 52 is disposed in front of the refrigerant pipes 26, the compactness of the indoor unit 1 can be achieved although the degree of the effect is varied.

(3-4)

In the above embodiment, all the gears 52 are disposed at positions where the gears 52 do not overlap the heat exchanger 20 as viewed from the side. Thus, the refrigerant pipes 26 need not to be arranged to avoid the gears 52. This makes it easy to design the arrangement of the panel drive unit 50 and the refrigerant pipes 26 in the compact indoor unit 1. In this embodiment, all the gears 52 are disposed at the positions where the gears 52 do not overlap the heat exchanger 20 as viewed from the side. However, when a part of the gears 52 is disposed at a position where the part of the gears 52 does not overlap the heat exchanger 20 as viewed from the side, the easy designing of the arrangement of the panel drive unit 50 and the refrigerant pipes 26 can be achieved although the degree of the effect is varied.

(3-5)

The gears 52 of the above embodiment configure the planetary gear mechanism, and thus the gears 52 as a moving part are concentrated near the extension line of the shaft 51*a* of the motor 51 to achieve the compactness of the indoor unit 1. In particular, the center CL3 of the longitudinal direction of the gears 52 disposed in front of the refrigerant pipes 26 is disposed between the heat transfer fins 23 of the heat exchanger 20 and the center CL2 of the longitudinal direction of the electric component box 70. Therefore, the effect of the compactness is enhanced.

(3-6)

As described with reference to FIG. 8, the center CL3 of the longitudinal direction of the gears 52 is disposed between the center CL1 of the longitudinal direction of the heat exchanger 20 and the center CL2 of the longitudinal direction of the electric component box 70. Thus, the indoor unit 1 can be made more compact in the longitudinal direction of the indoor unit 1 than a configuration in which the center of the gears 52 is disposed on the opposite side of the heat exchanger 20 with the electric component box 70 interposed therebetween.

(3-7)

The coupling member 40 is a component member of a parallel crank mechanism that converts the rotational movement of the panel drive unit 50 into a reciprocating movement of the front panel that reciprocates between the upper front position and the rear lower position. With the coupling member 40 configured as above, a small actuator that rotates such as the motor 51 can be used for the panel drive unit 50. Therefore, the compactness can be achieved at a low cost.

(4) Modifications (4-1) Modification 1A

In the description of the above embodiment, the planetary gear mechanism configured by the gears 52 of the panel drive unit 50 is the planetary type. The planetary gear mechanism, however, is not limited to the planetary type, but may be, for example, a solar type or a star type. Further, the mechanism configured by the gears 52 of the panel drive unit 50 is not limited to the planetary gear mechanism.

(4-2) Modification 1B

In the description of the above embodiment, the coupling member 40 is a component member of the parallel crank mechanism that converts the rotational movement of the panel drive unit 50 into the reciprocating movement of the front panel 11 that reciprocates between the upper front position and the rear lower position. The coupling member 40, however, may be a component member of another crank mechanism, and is not limited to the parallel crank mechanism.

Although the embodiment of the present invention has been described above, it will be understood that various changes in forms and details can be made without departing from the gist and scope of the present invention as set forth in the claims.

REFERENCE SIGNS LIST

1 Indoor unit
10 Casing
11 Front panel
20 Heat exchanger
25 U-shaped pipe
25*a* First U-shaped pipe
25*b* Second U-shaped pipe
40 Coupling member
41 First coupling member
42 Second coupling member
50 Panel drive unit
51 Motor
52 Gear
70 Electric component box

CITATION LIST

Patent Literature

Patent Literature 1: JP 2000-234760 A

The invention claimed is:

1. An indoor unit of an air conditioner, comprising:

a casing that has a front panel at a front of the casing and a back surface on a rear of the casing, the back surface being fixed to a wall;

a heat exchanger that is housed in the casing and has a first U-shaped pipe that returns refrigerant flowing in a longitudinal direction;

a panel drive unit that is housed in the casing and includes a motor that generates a driving force that moves the front panel by a movement of the motor itself; and a first coupling member that is disposed behind the front panel and includes a first crank, the first crank being coupled to the front panel and the panel drive unit, and transmits the driving force from the panel drive unit to the front panel, wherein the first coupling member is disposed in front of the first U-shaped pipe so as to at least partially overlap the first U-shaped pipe as viewed from a front of the indoor unit, and the motor is disposed on an opposite side of the heat exchanger with the first coupling member interposed therebetween as viewed from the front of the indoor unit.

2. The indoor unit of an air conditioner according to claim 1, comprising an electric component box that is housed in the casing and electrically connected to the panel drive unit, wherein the heat exchanger has a heat transfer fin, the panel drive unit includes a gear that transmits the driving force to the first coupling member, and the gear is disposed such that a center of the longitudinal direction of the gear is located between the heat transfer fin and a center of the longitudinal direction of the electric component box.

3. The indoor unit of an air conditioner according to claim 2, wherein the gear is disposed in front of a refrigerant pipe extending from the heat exchanger, and the first crank of the first coupling member rotates in accordance with a movement of the gear.

4. The indoor unit of an air conditioner according to claim 3, wherein the gear is disposed at a position where at least a part of the gear does not overlap the heat exchanger as viewed from a side of the indoor unit.

5. The indoor unit of an air conditioner according to claim 4, wherein the gear configures a planetary gear mechanism.

6. The indoor unit of an air conditioner according to claim 4, comprising:

a second U-shaped pipe disposed at an end of the heat exchanger to return the refrigerant flowing in the longitudinal direction; and a second coupling member disposed in front of the second U-shaped pipe so as to at least partially overlap the second U-shaped pipe as viewed from the front of the indoor unit, and includes a second crank.

7. The indoor unit of an air conditioner according to claim 4, wherein the first crank of the first coupling member is a component member of a crank mechanism that converts a rotational movement of the panel drive unit into a reciprocating movement of the front panel that reciprocates between an upper front position and a rear lower position.

8. The indoor unit of an air conditioner according to claim 3, wherein the gear configures a planetary gear mechanism.

9. The indoor unit of an air conditioner according to claim 3, comprising:

a second U-shaped pipe disposed at an end of the heat exchanger to return the refrigerant flowing in the longitudinal direction; and a second coupling member disposed in front of the second U-shaped pipe so as to at least partially overlap the second U-shaped pipe as viewed from the front of the indoor unit, and includes a second crank.

10. The indoor unit of an air conditioner according to claim 3, wherein the first crank of the first coupling member is a component member of a crank mechanism that converts a rotational movement of the panel drive unit into a reciprocating movement of the front panel that reciprocates between an upper front position and a rear lower position.

11. The indoor unit of an air conditioner according to claim 2, wherein the gear configures a planetary gear mechanism.

12. The indoor unit of an air conditioner according to claim 11, comprising:

a second U-shaped pipe disposed at an end of the heat exchanger to return the refrigerant flowing in the longitudinal direction; and a second coupling member disposed in front of the second U-shaped pipe so as to at least partially overlap the second U-shaped pipe as viewed from the front of the indoor unit, and includes a second crank.

13. The indoor unit of an air conditioner according to claim 11, wherein the first crank of the first coupling member is a component member of a crank mechanism that converts a rotational movement of the panel drive unit into a reciprocating movement of the front panel that reciprocates between an upper front position and a rear lower position.

14. The indoor unit of an air conditioner according to claim 2, wherein the gear is disposed at a position where at least a part of the gear does not overlap the heat exchanger as viewed from a side of the indoor unit.

15. The indoor unit of an air conditioner according to claim 2, comprising:

a second U-shaped pipe disposed at an end of the heat exchanger to return the refrigerant flowing in the longitudinal direction; and a second coupling member disposed in front of the second U-shaped pipe so as to at least partially overlap the second U-shaped pipe as viewed from the front of the indoor unit, and includes a second crank.

16. The indoor unit of an air conditioner according to claim 2, wherein the first crank of the first coupling member is a component member of a crank mechanism that converts a rotational movement of the panel drive unit into a reciprocating movement of the front panel that reciprocates between an upper front position and a rear lower position.

17. The indoor unit of an air conditioner according to claim 1, comprising:

a second U-shaped pipe disposed at an end of the heat exchanger to return the refrigerant flowing in the longitudinal direction; and a second coupling member disposed in front of the second U-shaped pipe so as to at least partially overlap the second U-shaped pipe as viewed from the front of the indoor unit, and includes a second crank, the second crank being coupled to the front panel and the panel drive unit, and transmits the driving force from the panel drive unit to the front panel.

18. The indoor unit of an air conditioner according to claim 17, wherein the first crank of the first coupling member is a component member of a crank mechanism that converts a rotational movement of the panel drive unit into a reciprocating movement of the front panel that reciprocates between an upper front position and a rear lower position.

19. The indoor unit of an air conditioner according to claim 1, wherein the first crank of the first coupling member is a component member of a crank mechanism that converts a rotational movement of the panel drive unit into a reciprocating movement of the front panel that reciprocates between an upper front position and a rear lower position.

* * * * *